United States Patent [19]

Dickinson

[11] Patent Number: 4,509,885

[45] **Date of Patent: * Apr. 9, 1985**

[54] SKIVING AND ROLLER BURNISHING TOOL

[76] Inventor: Lawrence C. Dickinson, 2255 Eva Adams, Reno, Nev. 89504

[ * ] Notice: The portion of the term of this patent subsequent to Jan. 11, 2000 has been disclaimed.

[21] Appl. No.: 401,580

[22] Filed: Jul. 26, 1982

Related U.S. Application Data

[63] Continuation-in-part of Ser. No. 301,503, Sep. 14, 1981, Pat. No. 4,425,693, Ser. No. 205,026, Nov. 7, 1980, Pat. No. 4,380,851, and Ser. No. 183,664, Sep. 2, 1980, Pat. No. 4,367,576.

[51] Int. Cl.[3] ..... B24B 39/00; B24B 39/02

[52] U.S. Cl. ..... 407/1; 29/90 R; 72/123; 408/22

[58] Field of Search ..... 407/1; 408/22, 130; 29/90 R; 72/122, 123, 125

[56] References Cited

U.S. PATENT DOCUMENTS

| | | | |
|---|---|---|---|
| 3,656,333 | 4/1972 | Kruse, Jr. | 29/90 |
| 3,736,633 | 6/1973 | Kalen | 29/90 |
| 3,791,000 | 2/1974 | Kunze | 29/90 |
| 3,795,957 | 3/1974 | Steusloff | 29/90 |
| 3,980,442 | 9/1976 | Riekeles | 29/90 |
| 4,133,089 | 1/1979 | Heymanns | 408/22 |
| 4,367,576 | 1/1983 | Dickinson | 29/90 R |
| 4,380,851 | 4/1983 | Dickinson | 72/123 |
| 4,425,693 | 1/1984 | Dickinson | 29/90 R |

FOREIGN PATENT DOCUMENTS

| | | | |
|---|---|---|---|
| 814580 | 3/1981 | U.S.S.R. | 407/1 |

*Primary Examiner*—Leonidas Vlachos
*Assistant Examiner*—Jerry Kearns
*Attorney, Agent, or Firm*—Townsend & Townsend

[57] ABSTRACT

A skiving and roller burnishing tool includes a plurality of frustoconically tapered rollers and a retractable knife for use in combination for finishing the internal surface of a cylindrical hole. The roller burnishing tool includes a roller race having a central axis and a frustoconical outer surface tapering radially outward and axially forward. The rollers are arranged about the outer surface of the race for rolling engagement with the internal surface of the hole. The smaller ends of the rollers face forward, and the taper of the rollers is such that the outermost surface portion of each roller is parallel to the central axis of the race. The rollers are biased in the forward direction using a roller pusher with a chosen force so that the force exerted on the internal surface of the hole remains constant over a range of sizes of the hole. The retractable knife includes a pair of radially extendible knife holders defining a camming path having an axial portion and an angled portion. A push dart has a camming element with complementary camming surfaces which ride along the camming path. Axial actuation of the push dart causes the knife holders to extend radially into a stable, locked position.

15 Claims, 14 Drawing Figures

SKIVING AND ROLLER BURNISHING TOOL

This application is a continuation-in-part of U.S. patent application Ser. No. 301,503 filed Sept. 14, 1981, and now U.S. Pat. No. 4,425,693 titled "Retractable Knife for Skiving Tool;" U.S. patent application Ser. No. 205,026 filed Nov. 7, 1980, and now U.S. Pat. No. 4,380,851 titled "Roller Burnishing Tool;" and U.S. patent application Ser. No. 183,664 filed Sept. 2, 1980, and now U.S. Pat. No. 4,367,576 titled "Skiving and Roller Burnishing Tool."

BACKGROUND OF THE INVENTION

The present invention relates to a combined skiving and roller burnishing tool having means for remotely actuating a rotary skiving knife simultaneously with the roller burnishing tool.

Rotary skiving tools are used to accurately cut small quantities of material from the wall of a cylindrical hole. After the skiving tool has made a pass through the workpiece it is usually drawn back through the newly worked hole. If the knife blades on the skiving tool are not retracted the blades will scratch or score the surface of the hole. This is totally unacceptable when unmarred finishes are needed, for example in hydraulic cylinders.

Retractable rotary skiving knives have been developed so that the knife blades do not score the cylinder wall (see, for example, U.S. Pat. No. 3,795,957). These tools typically use a knife holder having two knife blades. The knife blades are pulled inwardly by springs and are extended by pulling (or pushing) a shifting rod having a tapered end, against which the knife blades rest, to wedge the knife blades apart. Pushing (or pulling) the shifting rod allows the springs to pull the blades inwardly so the tool can be withdrawn from the workpiece. The distance the blades extend is determined by the distance the shifting rod moves and the angle of the tapered end. With this arrangement the radial forces on the knife blades are transmitted from the knife blades to the shifting rod to produce axial forces on the shifting rod. The extended position of the knife blades can vary, possibly resulting in an out-of-tolerance hole, depending upon several factors including the rigidity with which the shifting rod is locked into place and the amount of relative movement which occurs between the mating surfaces of the tapered end of the shifting rod and the knife blades. Further, centrifugal forces on the rotating knife tend to urge the knife blades outwardly in opposition to the springs.

Roller burnishing tools utilize a plurality of circumferentially spaced rollers in a roller cage to roller burnish the interior of a pre-formed cylindrical hole so that it has a smooth finish. Tools of this type are available in which rollers are located on a race which is inclined radially outwardly toward the rear, and a manually adjustable stop is provided which restricts the rearward movement of the rollers up the inclined race. Tools utilizing roller burnishers of this type are illustrated in a brochure of the Hegenscheidt Corporation, having a U.S. office at 1070 Livernois Avenue, Troy, Mich. 48084 entitled The Combined Skiving and Roller Finishing Tools, Type RDS RETRAC, and U.S. Pat. Nos. 3,795,957; 3,980,442 and 4,133,089.

When roller burnishing tools of the type described above are inserted in a cylinder, the forward thrust of the tool causes the rollers to move upwardly along the inclined race until the race contacts the preset stop.

Accordingly, for all practical purposes, the rollers have a preset radius depending on the position of the stop.

Roller burnishing tools of the type just described, i.e. those having effectively fixed radii, are generally satisfactory when the interior of the cylinder to be burnished is very close to the preset diameter of the tool. They are, however, are unsatisfactory when the actual inside diameter of the cylinder deviates substantially (either larger or smaller) from the nominal diameter. To overcome this drawback, roller burnishing tools have been provided in which the roller bearing race is inclined radially outward in the operative direction of the tool. The rollers are enclosed in a roller cage which is used to urge the rollers in the operative direction so that they translate radially outward until they engage the interior of the cylinder. In this way, as the tool is pushed (or drawn, through the cylinder, the rollers may be held against the interior of the cylinder by the roller cage, conforming to any slight deviations in the interior diameter. Such roller burnishing tools are disclosed in U.S. Pat. Nos. 3,791,000 and 3,656,333.

Although an improvement over roller burnishing tools which are unable to adapt to variations in the internal diameter of the workpiece, such adjustable roller burnishing tools suffer from certain drawbacks. In particular, the use of a roller cage having a plurality of slots for engaging the individual rollers and holding the rollers in place on the conical roller bearing surface as the tool is advanced through the workpiece often causes binding between the rollers and the cage (preventing the roller from rolling) and can lead to excessive wear both on the roller cage and on the individual rollers.

Skiving tools are often used in combination with a roller burnishing tool so that the skiving tool first cuts or shaves off a small amount of material from the hole and then the roller burnishing tool, mounted coaxially on the same drive shaft with the skiving tool, burnishes the hole to a smooth finish. Such combination tools are disclosed in U.S. Pat. Nos. 3,795,957; 3,980,442; and 4,133,089.

Heretofore combined skiving and burnishing tools which have included retractable rotary skiving knives have not been commercially available. The combination tools which have been available typically resemble the tool disclosed in U.S. Pat. No. 3,980,442 and include non-retractable blades in combination with a roller burnishing tool of the type described hereinbefore. Such tools are undesirable for the reasons previously set forth concerning skiving tools having non-retractable blades, ie. non-retractable blades often scratch or score the inside surface of the work piece.

One reason for the absence of combination skiving and roller burnishing tools having retractable rotary skiving knives is probably the difficulty encountered in providing means for simultaneously actuating both the skiving knives and the rollers comprising the roller burnishing tool. The combination tool is generally cylindrical having a diameter which is necessarily less than the diameter of the bore which is being finished. For that reason the available space for locating the necessary moving parts for actuating both parts of the combined tool is very limited. It is therefore desirable to provide a combined skiving and roller burnishing tool where the rotary skiving knives are retractable, and in particular it is desirable to provide a means for simultaneously actuating both the skiving knives and the burnishing rollers to make such a combination tool possible.

SUMMARY OF THE INVENTION

The present invention provides a skiving tool having a retractable knife used in combination with a roller burnishing tool. The combination is used for finishing the internal surface of a cylindrical hole by passing the tool through the hole in a forward direction. The roller burnishing tool is mounted to one end of a drive shaft with the skiving tool mounted forward of the burnishing tool.

The roller burnishing tool of the present invention burnishes the interior of a workpiece, typically a cylinder, by engaging said interior surface with a plurality of frustoconical rollers encompassed by a roller cage having a plurality of apertures for receiving said individual rollers. The frustoconical roller race is arranged so that its radius increases in the forward direction, that is the direction in which the tool is moved to polish the interior surface.

The retractable knife includes a knife blade radially movable with respect to the axis of the tool and a push dart which is operatively coupled to the blade so that axial motion of the push dart causes that blade to move radially between an extended and a retracted position.

A common means is provided for actuating both the retractable knife and the roller burnishing tool. The means includes a pair of concentric cylinders, one of which is coupled to the push dart and the other of which is coupled to the rollers. The cylinders are reciprocatably mounted within the tool and actuated by a preselected fluid pressure which acts on both pistons simultaneously. In this way, the skiving blade can be extended and the burnishing rollers urged against the interior of the work piece while the tool is in use by applying fluid pressure on the pistons, and both the blade and the rollers can be retracted by bleeding the fluid pressure to allow the tool to be removed from the work piece without scratching or scoring the now polished surface.

In the preferred embodiment, instead of using the roller cage to translate the rollers forward and outward along the roller race as with the prior art, the rollers are moved in the forward direction by a roller pusher which directly engages the rear surfaces of the rollers. Thus, contact between the rollers and the roller cage remains relatively loose, and the rollers remain free to rotate in the slots in the roller cage without binding. Since force is applied only to the rear surface of the rollers, wear on both the rollers and the roller cage is minimized.

The forward end of the roller pusher includes a flange which engages the roller cage to draw the roller cage rearward when it is desired to retract the individual rollers. The use of the roller cage to translate the individual rollers in the rearward direction will not lead to excessive wear on either the rollers nor the roller cage since the rollers are being moved away from contact with the interior of the workpiece and friction between the rollers and the roller cage is not a problem.

In the preferred embodiment, the retractable knife is mounted within a transverse slot in a knife support at the forward end of the tool. The retractable knife includes a pair of knife blade holders which can independently move radially within the slot in response to movement of an actuator mounted concentric with the central axis of the drive shaft. Knife blades are mounted to the knife blade holders and extend radially in opposite directions from the central axis of the drive shaft. The blade holders, mounted within the transverse slot, may move relative to one another only in a radial direction parallel to their opposed, mating faces. One blade holder has an axial guide slot formed within its face parallel to the central axis. The other blade holder defines a camming slot having an angled portion at an acute angle to the central axis and an axial portion parallel to the central axis.

A push dart, typically in the form of a generally rectangular bar, has one side sized for mating engagement within the axial guide slot of one blade holder. The push dart has a camming element formed on the opposite side and sized for complementary engagement within the camming slot of the guide dart. The camming element has a pair of parallel axial camming surfaces and a pair of parallel angled camming surfaces. The axial camming surfaces are parallel to the central axis and the angled camming surfaces are formed at the same acute angle to the angled portion of the camming slot. The push dart, captured between the two blade holders, is movable along the axial guide slot in the one blade holder and the camming slot in the guide dart.

The push dart is actuated via an axially mounted actuator pin which pushes the push dart forward against a return spring. The return spring is captured between the two blade holders and biases the push dart rearward. Initial forward movement of the push dart forces the guide dart along the angled portion of the camming slot causing the blade holders to move radially outwardly in opposite directions as the angled camming surfaces on the push dart move along the angled camming surfaces on the guide dart. Once the camming element of the push dart begins to move along the axial portion of the camming slot, the axial camming surfaces of the push dart engage the axial camming surfaces of the guide dart so that no further radial movement, inwardly or outwardly, of the knife blade holders occurs; rather, the knife blade holders become securely locked in their extended position.

No axial force is exerted on the actuator rod when fully forward since the radial forces exerted on the knife blades are transmitted to axially extending camming surface of the guide and push darts. The bearing stresses on the push dart and guide dart are minimized once the camming element of the push dart is fully engaged within the axial portion of the camming slot because their bearing area is relatively large.

The radial position of the guide dart in the elongate slot can be adjusted, typically via set screws, so the final extended position of the knife blades is adjustable.

The actuator pin is pushed forward by a hydraulic actuator piston. The actuator piston slides within a main hydraulic piston which applies the actuating force to the rollers. Thus, when used in combination with the hydraulically actuated burnishing tool, a single source of hydraulic fluid can be used to actuate both the retractable knife in the skiving tool and the rollers in the roller burnishing tool.

The roller burnishing tool includes a roller race having a central axis and a frustoconical outer surface tapering radially outward and axially forward. A plurality of frustoconically tapered rollers are arranged about the outer surface for rolling engagement with the outer surface with the smaller ends of the rollers facing forward. The taper of the rollers is such that the outermost surface portion of each roller is parallel to the central axis. The rollers are biased in the forward direction with a chosen force so that the force exerted on the internal surface of the hole remains constant over a range of sizes of the hole.

In the apparatus of the present invention, the roller race tapers outwardly in a forward direction, rather than outwardly in a rearward direction as in known devices. Forward movement of the tool does not press the rollers against the preset stop, but rather the rollers move backwardly until restrained by the selected axial force. As a result, the rollers will apply an equal burnishing force to the interior of the cylinder through a range of diameters. The rollers of the present invention automatically adjust to the diameter of the workpiece, and will not overwork the piece or become jammed inside.

The automatic adjustment features of the rollers of the present invention also facilitate the transfer of the tool from the draw tube to the cylinder. The rollers are actuated and forced outwardly while the roller burnishing portion of the tool is still in the draw tube to stabilize the initial action of the cutter blade. When the rollers themselves move from the draw tube to the cylinder, they will automatically adjust to any change in diameter.

The roller burnishing tool of the present invention is self-stabilizing as a result of the balanced forces provided by the rollers. Nylon pads are not used to stabilize the tool when the tool makes its working pass through the cylinder. Nylon pads are provided, however, which only contact the interior surface of the cylinder when the rollers have been retracted and the tool is being withdrawn. These nylon pads prevent the rollers from contacting the interior surface of the cylinder when the tool is being withdrawn which would destroy the quality of the surface.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
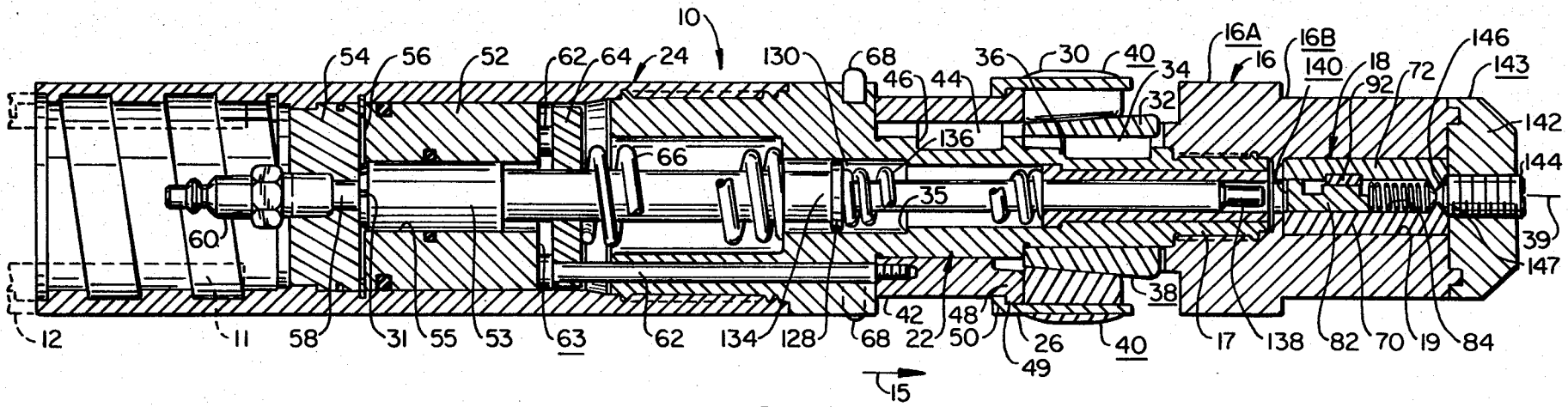
FIG. 1 is a sectional elevation view of the preferred embodiment of the combined skiving and roller burnishing tool of the present invention.
Figure 2:
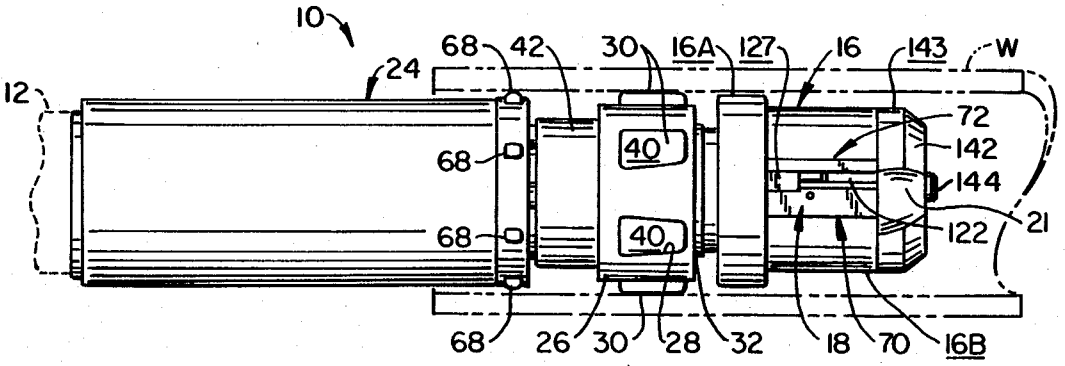
FIG. 2 is a side view of the tool of FIG. 1.
Figure 4:
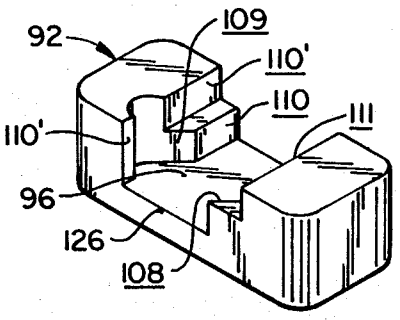
FIG. 4 is an isometric view of the guide dart.

The preferred embodiment 10 of the combined skiving and roller burnishing tool of the present invention is illustrated generally by way of reference to FIGS. 1 and 2. Tool 10 is mounted to the forward end 11 of a drive member 12 which drives the tool through the interior of a cylinder or other workpiece W. Most often, the tool 10 of the present invention is used to finish the interior surfaces of a large hydraulic or pneumatic cylinder.

Tool 10 includes a knife support 16 located toward the leading end of the tool. An end cap 142 is fixed to the leading end of knife support 16. The outer peripheral surface 16B of knife support 16 between rear surface 16A and end cap 142 is stepped down from surface 16A and a transverse slot 19 is provided in knife support 16 having axial dimensions generally equal to the stepped portion 16B of the knife support. A pair of coolant flow and chip extraction grooves 21 are formed in surface 143 of cap 142 on opposite sides generally aligned with slot 19.

A retractable knife 18 includes first and second knife blade holders 70, 72 extendible radially outwardly in opposite directions within slot 19. Knife holders 70, 72 have centered depressions 146, 147 respectively, and a spring plug 144 threadable engaged in end cap 142 maintains the holders in a centered or near centered position.

The radial movement of knife blade holders 70, 72 is controlled by a push dart 82 riding within a slot 74 in knife blade holder 70 which engages a guide dart 92 fixed to holder 72. A spring 84 biases push dart 82 rearwardly to maintain the knife blade holders in their normally retracted configuration. The push dart 82 actuates the knife blade holders and moves them radially outwardly; the details of the knife holder mechanism will be illustrated in more detail hereinafter.

Figure 3:
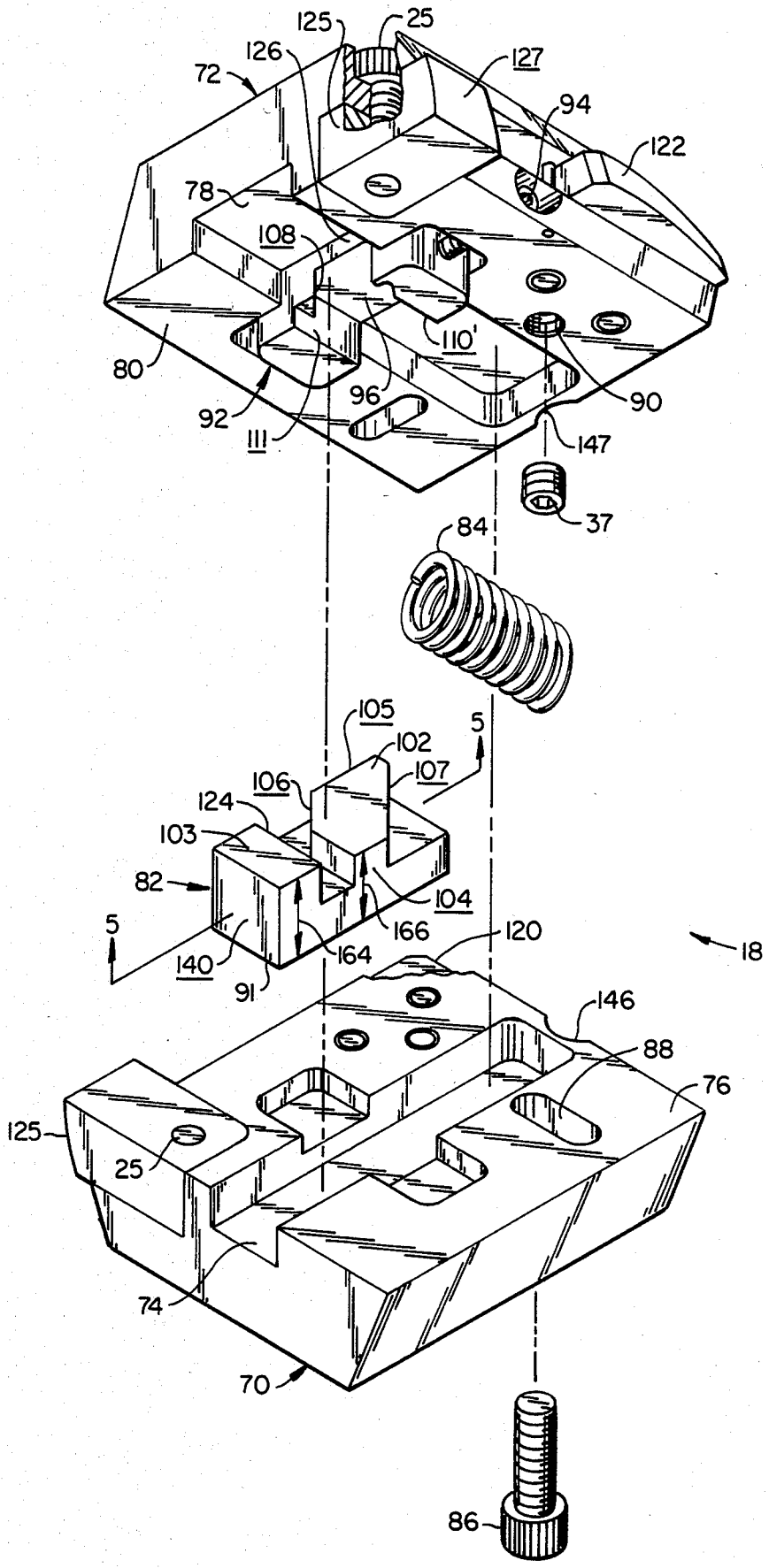
FIG. 3 is an exploded isometric view of a retractable knife made according to the present invention.

Knife blade holder 72 has a knife blade 122 and a support 125 having a knife blade supporting surface 127 at its outer extremity (see FIGS. 2 and 3). A corresponding knife blade 120 and support 125 are provided at the radial extremity of knife holder 70, as will be illustrated in more detail hereinafter. Supports 125 are fastened to holders 70, 72 by socket head cap screws 25 mounted within radially extending slots in the holders. This allows the radial adjustment of supports 125 according to the placement of blades 120, 122. When knife blade holders 70, 72 are actuated and moved radially outwardly, cutting knife blades 120, 122 and supports 125 extend radially beyond the outer surface 16A of knife support 16 to cut the interior of a workpiece W. When retracted, the knife blades and blade supporting surfaces are radially within peripheral surface 16A and will not contact the interior of workpiece W.

Knife support 16 is fixed to the leading end of a roller drive 22, which is in turn fixed to a drive tube 24 attachable to the forward end 11 of a drive member 12. A roller cage 26 circumscribes roller drive 22 aft of holder 16. Roller cage 26 has a plurality of apertures 28 (see FIG. 2) accommodating a corresponding plurality of rollers 30. The apertures 28 in cage 26 restrict the movement of rollers 30 while allowing the rollers to rotate and translate to a limited degree in a radial direction, as will be described in more detail below.

A roller race 32 circumscribes drive 22 beneath roller cage 26. Race 32 has a key 34 engaging a corresponding slot 36 in drive 22 so that the roller race is nonrotatable relative to the drive shaft.

Roller race 32 has an inclined outer surface 38 which is frustoconical in section. Surface 38 tapers outwardly in a forward direction. Rollers 30 are also frustoconical in section and have sufficient taper so that the rollers, bearing on surface 38 of race 32, are aligned so that their outer surfaces 40 are parallel to the common central axis 39 of roller drive 22 and drive member 12.

A roller pusher 42 circumscribes drive shaft 22, and also has a key 44 engaging a corresponding slot 46 in drive shaft 22 so that the roller pusher is nonrotatable relative to the drive shaft. Roller pusher 42 has a forward extension 48 which bears against the rear surfaces of rollers 30 so that the roller pusher can apply a forward force directly to the rollers. In addition, the forward extension 48 of roller pusher 42 has a lip 49 engaging a corresponding lip 50 on roller cage 26 so that aft movement of the roller pusher will draw the roller cage rearwardly.

A hydraulic (or possibly pneumatic) piston 52 is located in the interior of drive tube 24. A corresponding plug 54 is also located in drive tube 24 to define a cavity 56 between the plug and piston 52. A bore 58 in plug 54 communicates with a hydraulic or pneumatic fitting 60 which couples to a source of hydraulic or pneumatic fluid (not shown) within the drive member 12.

A plurality of dowel pins 62 emanate from the forward surface 63 of piston 52. Dowel pins 62 threadably engage the roller pusher 42, and a dowel retainer 64 secures the ends of dowel pins 62 near piston 52. A coil spring 66 biases dowel retainer 64 rearwardly so that dowel pins 62 are maintained in contact with the forward surface of piston 52.

Actuation of piston 52 by supplying a fluid through fitting 60 applies a forward force to dowel pin 62 which is transmitted through roller pusher 42 to rollers 30. This force moves rollers 30 up the inclined surface 38 of roller race 32 until the applied force is balanced by the force of the rollers against the interior of the workpiece.

It is readily apparent that rollers 30 will adapt themselves to the actual diameter of the interior of the cylinder, and will apply an equal force throughout a range of diameters depending upon the force applied to piston 52. Moreover, if the interior of the cylinder is undersized, the rollers will merely move a lesser distance up inclined surface 38, and there will be no tendency for the tool to jam in the workpiece. In addition, the fact that dowel pins 62 are not rigidly connected to piston 52 assures that an equal force is applied to all rollers 30, and the system is selfstabilizing and does not require an independent stabilizing mechanism such as nylon pads which contact the inside of the hole which the roller burnishing is taking place.

Piston 52 includes a central bore 55 which serves as a cylinder 55 for an elongate actuator piston 53. The forward end of actuator piston 53 passes through the interior of a bore 130 in roller drive 22. The actuator piston has a raised shoulder 134 with washer 128 abutting thereagainst to be biased rearwardly by a spring 136 until actuator piston 53 contacts plug 54. A groove 31 is provided in the end of piston 53 abutting plug 54 to allow fluid to pass from bore 58 into cavity 56. When pressurized fluid is supplied through bore 58 to cavity 56, not only does piston 52 move forwardly, but also, when pressure is sufficient, piston 53 moves forwardly as well. The leading end 13 of the actuator piston forces push dart 82 forwardly to actuate knife blade holders 70, 72. The forward travel of actuator piston 53 is limited by the abutment of washer 128 against shoulder 35. This insures that piston 53 does not become jammed against knife 18 which would prevent the desirable self-centering action of the knife in slot 19.

A plurality of guide pads 68, which may be nylon, can be provided about the outer circumference of tool 10. Pads 68 have a lesser diameter than knife blades 120, 122 and rollers 30 when the knife blades and rollers are actuated so that the pads do not contact the interior of the cylinder while cutting and roller burnishing are taking place. However, when tool 10 is retracted, pistons 52 and 53 are deactuated and springs 66 and 136 bias them to their closed positions to retract the knife blades and the rollers. In this configuration, pads 68 have a greater diameter than the knife blades and the rollers and the tool will slide smoothly out of the interior of the cylinder on the pads and will not score the surface.

Turning now to the remainder of the figures, retractable knife 18 will be described in more detail.

Knife blade holders 70, 72 are secured together using screw 86 which passes through a slot 88 in holder 70 and threadably engages a threaded bore 90 in holder 72. The depth of bore 90 is adjusted by a setscrew 37 so that screw 86 bottoms out before rigidly compressing holders 70, 72 together. The elongate shape of slot 88 permits holders 70, 72 to move radially, that is, parallel to abutting faces 76, 80 and perpendicular to central axis 39.

A generally rectangular push dart 82 is located within slots 74 and 78 in knife holders 70, 72 respectively. Push dart 82 has a rectangular base 91, a camming member 102, and an end member 103 projecting upwardly from the base, which will be described in more detail hereinafter. Base 91 of push dart 82 is sized for complementary sliding engagement along axial guide slot 74 of holder 70 so that the push dart is movable longitudinally relative to holder 70, but its lateral (radial) position relative to holder 70 is fixed. Return spring 84 biases push dart 82 in a rearward direction.

A guide dart 92 is located in a recess in knife blade holder 72 which traverses axial slot 78. The position of guide dart 92, which determines actual bore size in cylinder to be finished, is adjustable by virtue of a pair of screws 94, but once the position of guide dart 92 is adjusted it remains fixed relative to knife blade holder 72.

The relative position of knife blade holders 70 and 72 is determined by the interaction of push dart 82 and guide dart 92 when the push dart is moved axially against return spring 84. The camming element 102 of push dart 82 moves through slot 96 in guide dart 92, and the camming surfaces 104–107 of element 102 engage surfaces 110, 111, 108 and 109 of slot 96 respectively to cause relative movement, as illustrated in more detail hereinafter.

Figure 5A:
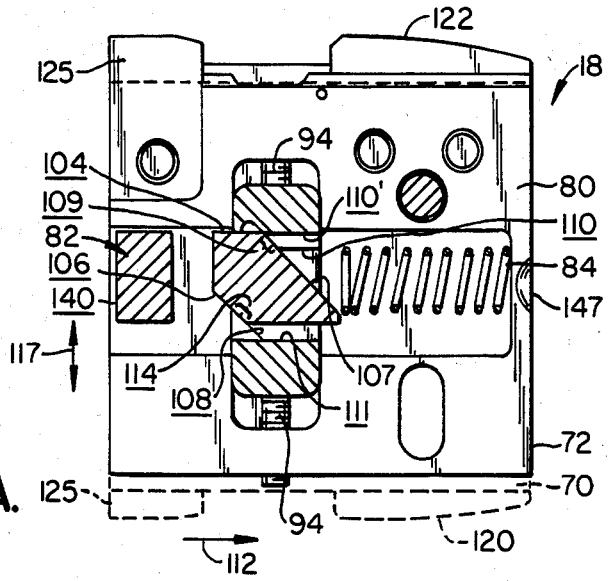
FIG. 5A is a cross-sectional view of the knife of FIG. 3 taken along line 5—5 but shown assembled with the outside edges of the first knife blade holder shown in dashed lines and with the push dart in its rearward position and the blade holders in their retracted positions.
Figure 5B:
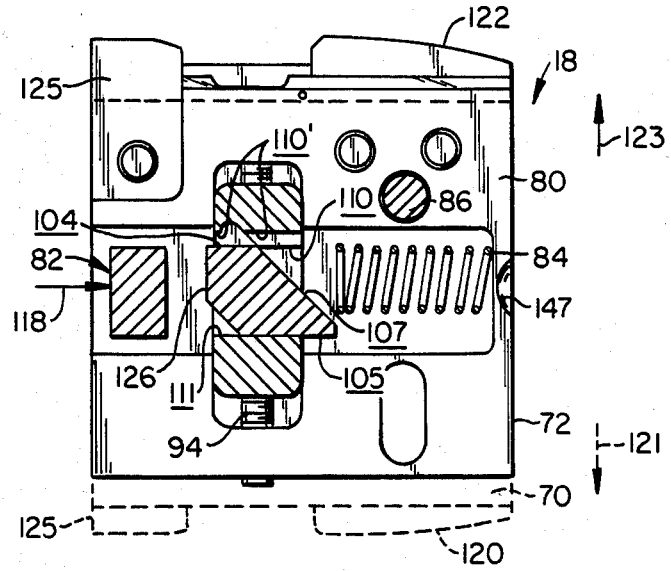
FIG. 5B shows the knife of FIG. 5A with the push dart partially forward and the knife blade holders fully extended.
Figure 5C:
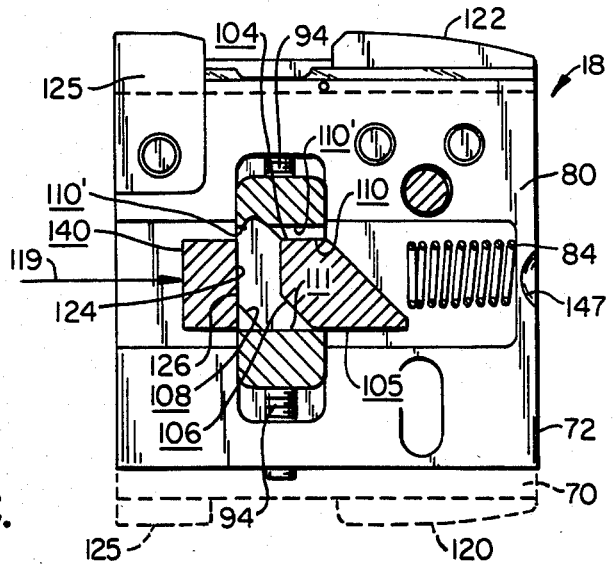
FIG. 5C shows the knife of FIG. 5A with the push dart more fully forward than in FIG. 5B and the knife blade holders fully extended and locked in position.
Figure 6:
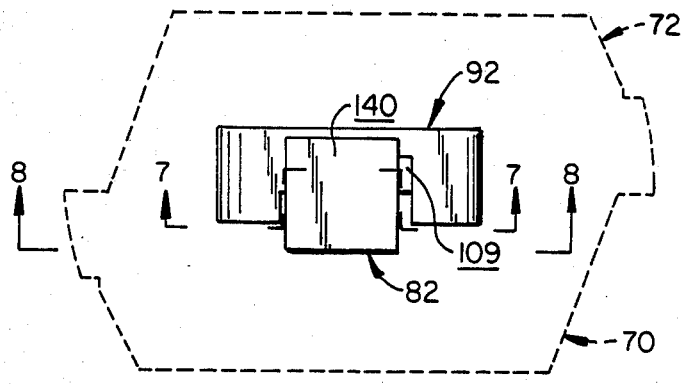
FIG. 6 is a forward facing end view of the guide and push darts of FIG. 5A showing the outline of the knife blade holders in dashed lines.

FIGS. 7A-7C and 8A-8C illustrate in a simplified manner the movement of push dart 82 along camming slot 96 of guide dart 92 in the corresponding FIGS. 5A-5C. The starting position of an aft surface 140 of push dart 82 when in a fully retracted position is represented by cutting plane line 162. Even though push dart 82 moves both radially as well as axially during use, for clarity of understanding the movement of the push dart in FIGS. 7A-7C and 8A-8C is assumed to be along a centerline 160.

Figure 7A:
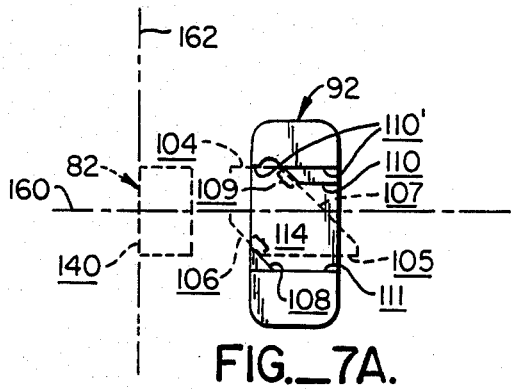
FIGS. 7A-7C are simplified views taken along line 7—7 of FIG. 6 showing the guide dart in solid lines and the push dart in dashed lines representing their relative positions in FIGS. 5A-5C.
Figure 8A:
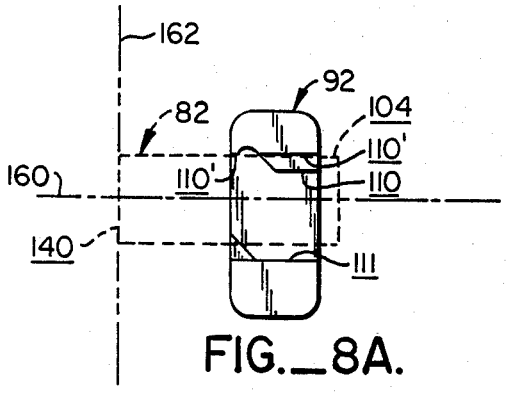
FIGS. 8A-8C are simplified views taken along line 8—8 of FIG. 6 showing the guide dart in solid lines and the push dart in dashed lines representing their relative positions in FIGS. 5A-5C.

Turning now to FIGS. 5A, 7A and 8A, knife 18 is shown in its fully retracted position. Spring 84 biases push dart 82 rearwardly in a direction opposite that of arrow 112. The lower portion 114 of surface 106 of push dart 82 abuts surface 108 of guide dart 92, preventing further rearward movement of the guide dart unless it is allowed to move upwardly relative to guide dart 92 (see FIG. 7A). However, upward movement of push dart 82 relative to guide dart 92 is prevented by the contact of the surface 104 of the push dart against surface 110' of the guide dart, as illustrated in FIG. 8A. Push dart 82 is prevented from rotating relative to guide dart 92 by the fact that the base of the push dart can only slide axially in slot 74 in knife blade holder 70 (see FIG. 3).

Figure 7B:
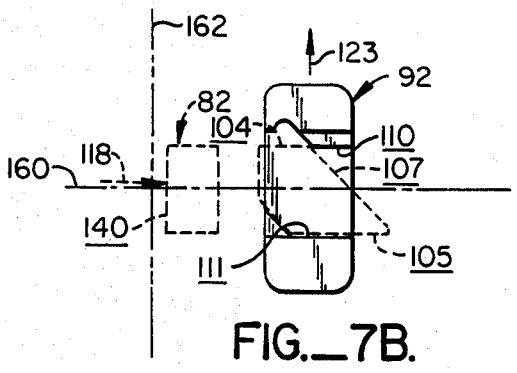
Figure 8B:
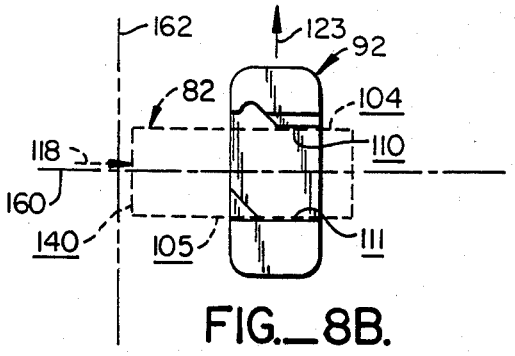

When actuator 138 (see FIG. 1) is actuated and moved forwardly, a force is applied to push dart 82 as illustrated by arrow 118 in FIGS. 5B, 7B and 8B, moving the push dart in the direction of the arrow. Comparing FIGS. 7A and 7B, it is apparent that surface 107 of the push dart slides along surface 109 of guide dart 92, causing guide dart 92 to move relatively upwardly as illustrated by arrow 123. The upward movement of guide dart 92 is halted when surface 105 of push dart 82 reaches surface 111 of guide dart 92, at which time surfaces 107 and 109 of the push and guide darts respectively no longer contact one another. In this position, surface 104 of push dart 82 is aligned with surface 110 of guide dart 92 (see FIG. 7B) so that the push dart is free to move forwardly relative to the guide dart. In the position illustrated in FIGS. 5B, 7B and 8B, the relative vertical movement between push dart 82 and guide dart 92 has reached its fullest extent and the knife blade holders 70, 72 are fully extended (see FIG. 5B), holder 72 in the direction of arrow 123 and holder 70 in the direction of arrow 121.

Figure 7C:
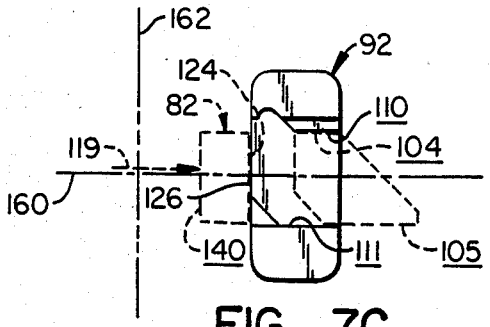
Figure 8C:
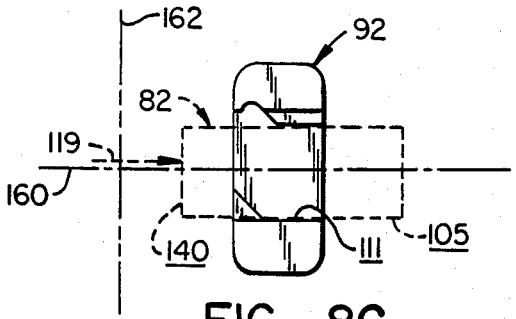

After push dart 82 and guide dart 92 have moved laterally to fully extend the knife blade holders, as illustrated in FIGS. 7B and 8B, push dart 82 continues to move forwardly as illustrated in FIGS. 5C, 7C and 8C. Surfaces 104 and 105 of push dart 82 slide along surfaces 110, 111 of guide dart 92 respectively until the front surface 124 of raised portion 103 of the push dart contacts surface 124 of the guide dart, preventing further forward movement of the push dart. In this position the push and guide darts provide a positive locking action which insures that the knife blade holders remain in their fully extended configuration. Further, the bearing area between the push and guide darts which will resist retraction of the knife blade holders, that is surface 104 of the push dart against surface 110 of the guide dart, is relatively large to reduce bearing stresses and wear. The operational stability of the knife is therefore assured.

In operation, tool 10 is actuated by supplying hydraulic or pneumatic fluid under pressure through fitting 60 to chamber 56. While the tool is still in the draw tube the pressure is reduced so the inside of the draw tube does not become overworked. The hydraulic fluid moves piston 52 forwardly, against spring 66, forcing roller pusher 42 against rollers 30 to move them up frustoconical ramp 38. In addition, the hydraulic or pneumatic fluid in chamber 56 forces piston 53 forwardly against spring 136 so that end 138 of piston 53 moves push dart 82 forwardly. Push dart 82 interacts with guide dart 92 to extend knife blade holder 70, 72 to their fully extended position, and continues to move forwardly to lock the knife blade holders in their extended position.

In the extended configuration of knife blade holders 70, 72, knife blades 120, 122 and their corresponding supports 125 project outwardly beyond the periphery 16A of the knife blade holder and are in position to provide the appropriate cutting action. As tool 10 is advanced through the interior of a workpiece W, it both cuts and roller burnishes the workpiece, and at the finish of its traverse, the rollers and knife blades are both retracted and the tool withdrawn from the workpiece on pads 68.

While a preferred embodiment of the present invention has been illustrated in detail, it is apparent that modifications and adaptations of that embodiment will occur to those skilled in the art. For example, the camming element could be formed on a stationary dart mounted to holder 72 with the camming slot formed in a push dart. Also, a pull dart rather than a push dart could be used if desired. However, it is to be expressly understood that such modifications and adaptations are within the spirit and scope of the present invention, as set forth in the following claims.

What is claimed is:

1. A skiving and roller burnishing tool comprising:

an elongate drive tube having a central axis defining a forward and a rearward direction;

a retractable knife mounted at the forward end of the drive tube, said knife including a knife blade radially movable with respect to the axis of the drive tube, a push dart movable path along an axial path, and means for coupling the push dart to the blade so that the blade is retracted when the push dart is in a first axial position and extended when the blade is in a second axial position;

a roller race mounted coaxially on the drive tube to the rear of the retractable knife and having a frustoconical outer surface tapering radially outward in the axially forward direction;

a plurality of frustoconical tapered rollers each having a large end and a small end and being arranged about said outer surface with the small ends of the rollers facing forward so that the surface portion of each roller furthest from the roller race is generally parallel to said central axis and the rollers may be extended radially outward by moving forward along the roller race;

a roller cage having a plurality of slots, said roller cage circumscribing and being spaced apart from the roller race so that said slots and said roller race together define a plurality of cavities for receiving individual rollers; and means for selectively biasing both the push dart and the rollers in (1) the forward direction so that the blade and the rollers may be simultaneously extended and (2) means for biasing both the push dart and the rollers in the rearward direction so that the blade and the rollers may be simultaneously retracted, said means for selectively biasing including a pair of concentric pistons mounted to reciprocate axially in the drive tube, one of the pistons being coupled to the push dart and the other being coupled to the rollers, and means for applying a preselected fluid pressure to both pistons simultaneously to bias said pistons in opposition to said rearward biasing means whereby the blade and the rollers may be simultaneously extended.

2. A tool as in claim 1, wherein the means for selectively biasing further includes an elongate rod for coupling the one piston to the push dart, said one piston and said rod being disposed along the axis of the drive tube, and a plurality of pins for coupling the other piston to the rollers, said other piston and said pins being disposed concentrically about the one piston and rod.

3. A tool as in claim 2, further including a roller pusher for coupling the pins to the rollers and roller cage, said roller pusher including (1) a forward extension for directly engaging the rear surfaces of individual rollers when the pusher is moved forwardly relative to the roller race to push the rollers forward and cause the rollers to translate radially outward along the tapered surfaces of the roller race within the cavities defined by the roller cage, and (2) a lip for directly engaging the roller cage when the pusher is moved rearwardly relative to the roller race to draw the rollers rearward and allow the rollers to translate radially inward.

4. A tool as in claim 3, wherein the retractable knife further includes at least one additional knife blade and a movable knife blade holder for each blade, each said knife blade holder having one knife blade radially extending therefrom, said push dart and one of said knife blade holders defining first means for interconnecting said push dart and said one blade holder along a first path, said push dart and another of said knife blade holders defining second means for interconnecting said push dart and said another blade holder along a second path, said second path having a first portion at an acute angle to said central axis and a second portion parallel to said central axis, whereby said first and second interconnecting means move said knife blades between first and second radial positions and positively maintain said knife blade holders in said second radial position in response to movement of said push dart along said axial path.

5. A skiving and roller burnishing tool comprising:

an elongate drive shaft having a central axis defining a forward and a rearward direction;

a retractable knife mounted to said drive shaft at the forward end thereof;

a roller race mounted coaxially on the drive shaft to the rear of the retractable knife and having a frustoconical outer surface tapering radially outward in the axially forward direction;

a plurality of frustoconical tapered rollers each having a large end and a small end and being arranged about said outer surface with the small ends of the rollers facing forward so that the surface portion of each roller furthest from the central axis roller race is generally parallel to said central axis;

a roller cage having a plurality of slots, said roller cage circumscribing and being spaced apart from the roller race so that said slots and said roller race together define a plurality of cavities for receiving individual rollers;

a roller pusher having (1) a forward extension for directly engaging the rear surfaces in individual rollers when the pusher is moved forwardly relative to the roller race push the rollers forward and cause the rollers to translate radially outward along the tapered surfaces of the roller race within the cavities defined by the roller cage, and (2) a lip for directly engaging the roller cage when the pusher is moved rearwardly relative to the roller race to draw the rollers rearward and allow the rollers to translate radially inward;

means for biasing the roller pusher in said forward direction with a chosen force so that the force exerted on the internal surface of said hole remains constant over a range of sizes of said hole; and means for retracting the roller pusher when the axial force is reduced to draw the roller cage rearwardly so that the rollers move radially inward and the tool can be withdrawn from the workpiece.

6. A skiving and roller burnishing tool as in claim 5, wherein the retractable knife is mounted to said drive shaft and includes movable knife blade holders, each said knife blade holders having a radially extending knife blade mounted thereto, said knife including a push dart movable between a first axial position and a second axial position, said push dart and one said knife blade holder defining first means for interconnecting said push dart and said one blade holder along a first path, said push dart and another said knife blade holder defining second means for interconnecting said push dart and said another blade holder along a second path, said second path having a first portion at an acute angle to said central axis and a second portion parallel to said central axis, whereby said first and second interconnecting means move said knife blades between first and second radial positions and positively maintain said knife holder in said second radial position in response to movement of said push dart along said paths; and further including actuator means for selectively moving said push dart between said first axial position and said second axial position.

7. The tool of claim 6 wherein said first path is generally parallel to said central axis.

8. The tool of claim 6 wherein:

said dart includes a pair of parallel spaced apart first cam surfaces, said first cam surfaces parallel to said axis, and a pair of parallel spaced apart second cam surfaces at an acture angle to said axis;

said knife includes a first cam surface means for mating engagement with said first cam surfaces of said dart as said dart moves between said first axial position and an intermediate position thereby moving said knife blades between said first radial position and said second radial position; and said knife includes a second cam surface means for mating engagement with said second cam surfaces of said dart as said dart moves between said intermediate position and said second axial position thereby maintaining said knife blades in said second radial position so that the engagement of said second cam surface means and said second cam surfaces lock said knife blades in said second position.

9. The tool of claim 8 further comprising means for biasing said dart toward said first axial position.

10. The tool of claim 8 wherein said actuator means includes an actuator piston operably coupled to said push dart.

11. The tool of claim 10 wherein said actuator means includes means for fluidly coupling said actuator piston to a pressurized fluid.

12. The tool of claim 11 wherein said actuator means includes a spring biasing one end of said actuator piston away from said push dart.

13. The tool of claim 5 wherein said drive shaft defines a transverse slot therethrough sized for mounting of said retractable knife therein.

14. The tool of claim 13 further comprising means for resiliently centering said movable knife blade holders toward the central axis of said drive shaft.

15. The tool of claim 13 wherein said movable knife blade holders have concave portions along adjacent surfaces of said holders, said concave portions aligned when said holders are at retracted radial positions, and a centering member mounted to said drive shaft and biased to resiliently engage said concave portions to bias said holders toward the central axis of said drive shaft thereby centering said movable knife blade holders.

* * * * *